US005477558A

United States Patent [19]

Völker et al.

[11] Patent Number: 5,477,558

[45] Date of Patent: Dec. 26, 1995

[54] MULTILAYER GROOVED PROTECTOR FOR BODY JOINTS

[75] Inventors: Alfred Völker, Köln; Hans-Georg Plecity, Düsseldorf; Jörn Steffens, Neuss; Anselm Zessler, Ratingen, all of Germany

[73] Assignees: Hein Gericke GmbH & Co. KG, Düsseldorf; ISL Schaumstoff-Technik GmbH, Viernheim, both of Germany

[21] Appl. No.: 397,541

[22] Filed: Mar. 2, 1995

Related U.S. Application Data

[63] Continuation of Ser. No. 981,625, Nov. 25, 1992, abandoned.

[30] Foreign Application Priority Data

Sep. 2, 1992 [DE] Germany ..... 42 29 328.6

[51] Int. Cl.[6] ..... A41D 13/08

[52] U.S. Cl. ..... 2/2; 2/16; 2/22; 2/24; 2/267

[58] Field of Search ..... 2/2, 2.5, 16, 22, 2/24, 23, 267, 268

[56] References Cited

U.S. PATENT DOCUMENTS

| | | | |
|---|---|---|---|
| 3,125,762 | 3/1964 | Glahe | 2/2 |
| 3,574,861 | 4/1971 | Hale | 2/2 |
| 3,772,704 | 11/1973 | Carbonneau | 2/22 |
| 4,481,679 | 11/1984 | Hayes | 2/2 |
| 4,525,875 | 7/1985 | Tomczak . | |
| 4,847,913 | 7/1989 | Chen | 2/2.5 |
| 5,020,156 | 6/1991 | Neuhalfen | 2/2 |
| 5,172,425 | 12/1992 | Smith | 2/22 |

FOREIGN PATENT DOCUMENTS

| | | |
|---|---|---|
| 3719895 | 6/1987 | Germany . |
| 9102039 | 6/1991 | Germany . |

*Primary Examiner*—C. D. Crowder
*Assistant Examiner*—Gloria Hale
*Attorney, Agent, or Firm*—Anderson Kill Olick & Oshinsky

[57] ABSTRACT

A protector, particularly for protective clothing of motorcyclists, comprises an underlay comprising shock-absorbing segments, a covering layer of a yielding material, grooves having a wedge-shaped section located between the segments, and empty spaces between complementary outer edges of the protector that disappear on bending it into the form of a shell.

7 Claims, 5 Drawing Sheets

ELBOW

KNEE LONG

KNEE SHORT

SHOULDER

ELBOW

MULTILAYER GROOVED PROTECTOR FOR BODY JOINTS

This is a continuation application of Ser. No. 07/981,625, filed Nov. 25, 1992, now abandoned.

TECHNICAL FIELD OF THE INVENTION

The invention relates to a protector, particularly useful for protecting endangered parts of the body such as the knees, elbows, hips, spine and shoulders of motorcyclists.

BACKGROUND OF THE INVENTION AND PRIOR ART

Such protectors form parts of conventional protective clothing such as trousers, jackets and overalls of leather or a synthetic material; they are normally located in corresponding pockets associated with the parts of the body to be protected or are connected to the protective clothing in the desired position either separably, for example by means of a Velcro burr fastener, or permanently by adhesion.

In case of a fall the protectors absorb the energy of the shock or impact with the impact surfaces and corners, which are generally hard, and protect the parts of the body that they cover. However, for effective body protection a compromise is needed in practice between on the one hand sufficient flexibility not to restrict the driver's freedom of movement too much and the necessary adaptation to the contours of the body, and on the other hand adequate absorption of the impact energy, which in view of the forces that come to act in the case of a fall requires a high degree of compressive strength.

There have been a series of proposals aimed at solving the problem of meeting these conflicting requirements. Thus for example German utility model specification 84 26 849 proposes a link-conveyor-like spine protector made up of individual plates of a deformation-resistant material such as light metal or steel arranged between an abrasion-resistant fabric layer and a leather layer. To ensure the closest possible fit to the body the plates are bent to the shape of the body, but are themselves resistant to bending.

The manufacture of a protector of this kind is extraordinarily troublesome and expensive, since it is difficult to bring the individual preshaped plates closely together between the individual covering layers. In addition there is a limit to the maximum curvature of the protector from the point of view of adequate protection in the case of accident, quite apart from the fact that the protector can only be curved along its length; it is therefore only suitable for use as a back or spine protector.

In another protector, likewise made up of cushioning elements hinged together, that is known from German Offenlegungsschrift 34 01 111, a generally T-shaped curved cushioning element overlaps the upper part of the spinal region and the shoulder part of the rider like a claw. This T-shaped part is however made in one piece and is substantially inflexible, so that it forms a rigid shell embracing the shoulder and neck region of the wearer.

To give the greatest possible adaptability, German utility model specification 91 02 039 proposes an accident protector of an impact-absorbing synthetic foamed plastic that is made after the manner of a bar of chocolate but with its wedge-shaped grooves filled up with an elastic cold-formable plastic foam material. In this way the protector can be bent substantially semi-cylindrically at least along its grooves. This known protector does not however allow of bending into the shape of a dome, as is necessary for example for an elbow or knee protector with a correspondingly small radius.

OBJECT OF THE INVENTION

It is an object of the present invention to provide a protector that not only ensures the wearer a particularly high degree of impact protection, but in addition can be shaped to conform with the body without any substantial restriction of the rider's freedom of movement.

SUMMARY OF THE INVENTION

This is achieved according to the invention by a protector comprising a flexible underlay on which are located shock-absorbing segments, for example of a hard, tough foamed plastic having a microporous structure, a covering layer of a non-rigid material, and also wedge-shaped grooves located between the segments and empty spaces between complementary outer edges of the protector that disappear on bending it into the form of a shell. Accordingly the individual segments are enclosed between the underlay and the covering layer, as it were as a shock-absorbing core.

In the as-manufactured or normal state the protector of the invention is thus a flat structure that corresponds to a development of an in situ configuration in the form of a shell. This flat structure can be brought into the form of a dome-shaped elbow or knee protector by bending along the wedge-shaped grooves and bringing together the complementary outer edges. In this way the protector can be transported, stored and handled in the flat state in a very small space, while its deformability enables it to be put into the pocket of an article of protective clothing. There the protector then assumes a more or less highly convex form, already to a large extent adapted to the part of the body to be protected, and at the same time ensures a high degree of freedom of movement, since in situ the protector can be moved between a spheroidal form and a plate as required.

In the protector of the invention the segments can consist of an open-cell foamed plastic, for example an aerated or expanded polystyrene or polystyrene heteropolymer, which can in addition be impregnated by any of conventional means used to that effect so that the pores are more or less completely closed off from the surface. In this way the escape of air in the case of deformation is slowed down and the absorption of the energy of the impact or shock is improved.

The underlay and covering layer preferably consist of polyethylene foam (PE), with the underlay facing the body having a greater elasticity than the outwardly-facing covering layer, of which the protective action is of primary importance. The elastic underlay makes wearing more comfortable.

To avoid point loading of the segments, pressure distributor layers, for example of polypropylene, cardboard or a similar stable material, can be located between the faces of the truncated pyramidal segments that face outwards in situ and the coating layer. The pressure distributor layers can however, alternatively or in addition, be located between the underlay and the truncated pyramid faces that face it.

The segments, which are, preferably, have a form of a truncated pyramid, are preferably welded between the two layers, an underlay and a covering layer. Alternatively the segments can be embedded in an elastic body of base mounting material, which serves on one side as an underlay and on the opposite side as a covering layer.

Finally the underlay can also be provided with recesses which are formed in an underlay surface adjacent to the body and which provide some degree of ventilation of the underlay surface.

In making the protectors, according to the invention the grooves bounding the segments are first formed by stamping in a plate of foamed plastic, the edges of which may also be cut by stamping. The resulting blank, the segments of which are still connected together by thin webs at the bottoms of the grooves, is then laid on a complementary underlay, covered with the covering layer, and the underlay, the segment plate and the covering layer are welded together parallel to the grooves and the edges. In doing this the webs between the segments may be more or less completely squeezed away in the course of the welding, so that at the bottom of the grooves the underlay and the covering layer are more or less directly welded together.

If a pressure distribution layer is to be used, this may first be bonded to the foamed plastic plate before the grooves are formed or stamped in the foamed plastic plate.

An underlay provided with segment pockets can simply be formed from a blank of foamed polyethylene by hot forming. After placing the grooved segment plate in position the outwardly facing segment surfaces can be fitted with a pressure distributor in the form of a plate having the same contour, for example of cardboard or polypropylene (PP), before the coating layer is laid on top.

The webs made up of the underlay welded to the covering layer that bound and at the same time connect the individual segments, and the adjacent edges of individual segments that adjoin one another in the developed state of the protector, permit hinge-like folding over of individual panels, each consisting of one or more segments, until the complementary outside edges meet on reaching the desired spheroidal form.

A further advantage of the protector of the invention is that by removal of individual segments or groups of segments it can readily be adapted to the size and ergonomic individuality of the parts of the body to be protected.

BRIEF DESCRIPTION OF THE DRAWINGS

The invention will now be described in more detail, by way of example, with reference to embodiments shown in the drawings, in which.

DETAILED DESCRIPTION OF PREFERRED EMBODIMENTS OF THE INVENTION

The knee protector consists of individual segments 1, 2, 3, between which grooves 4 or empty spaces 5 are located. Furthermore the protector has at the top and bottom a holding tab (6, 7) for fixing in an article of clothing.

Figure 1:
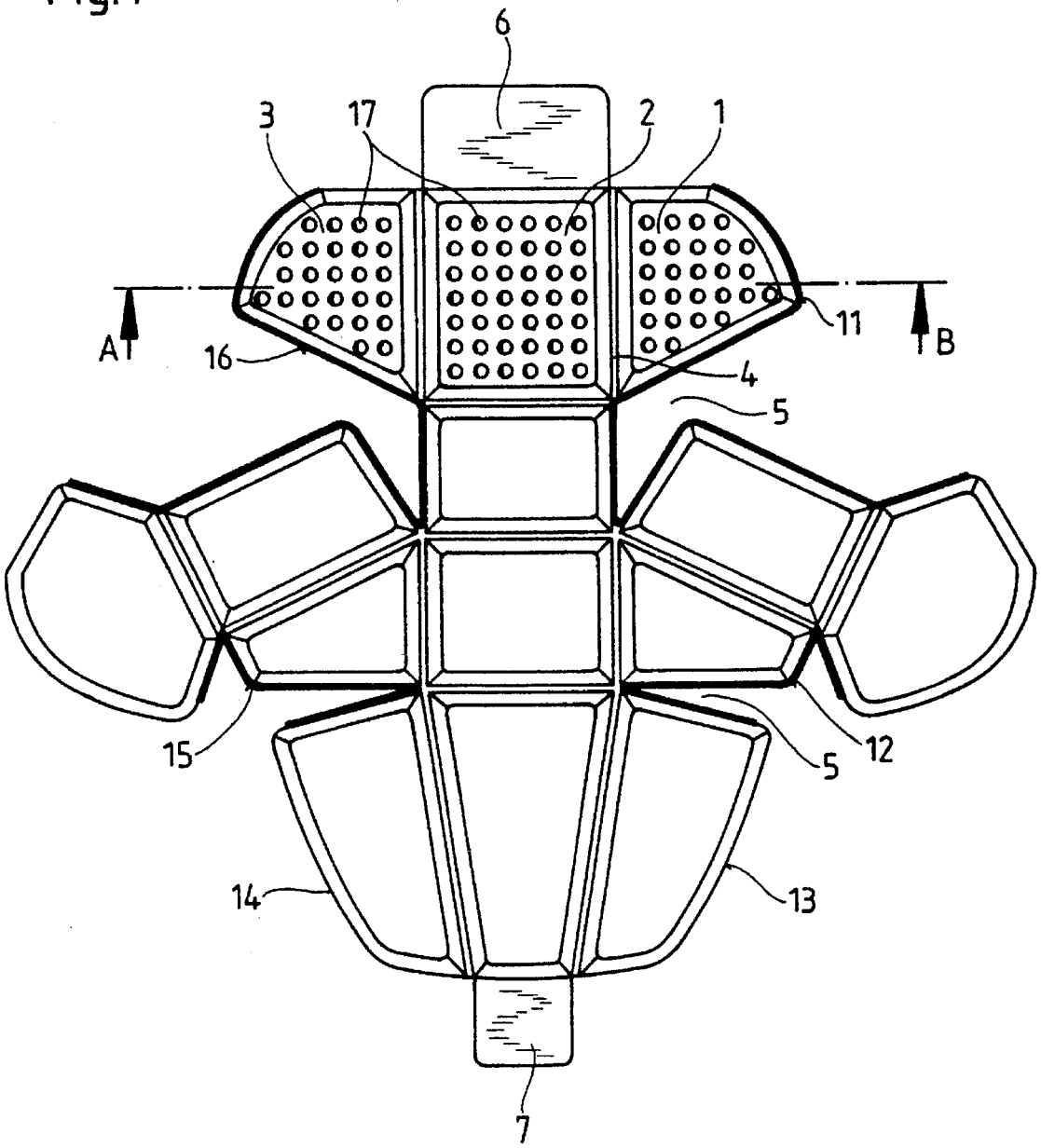
FIG. 1 is a plan view from above of the development of a knee protector.
Figure 2:
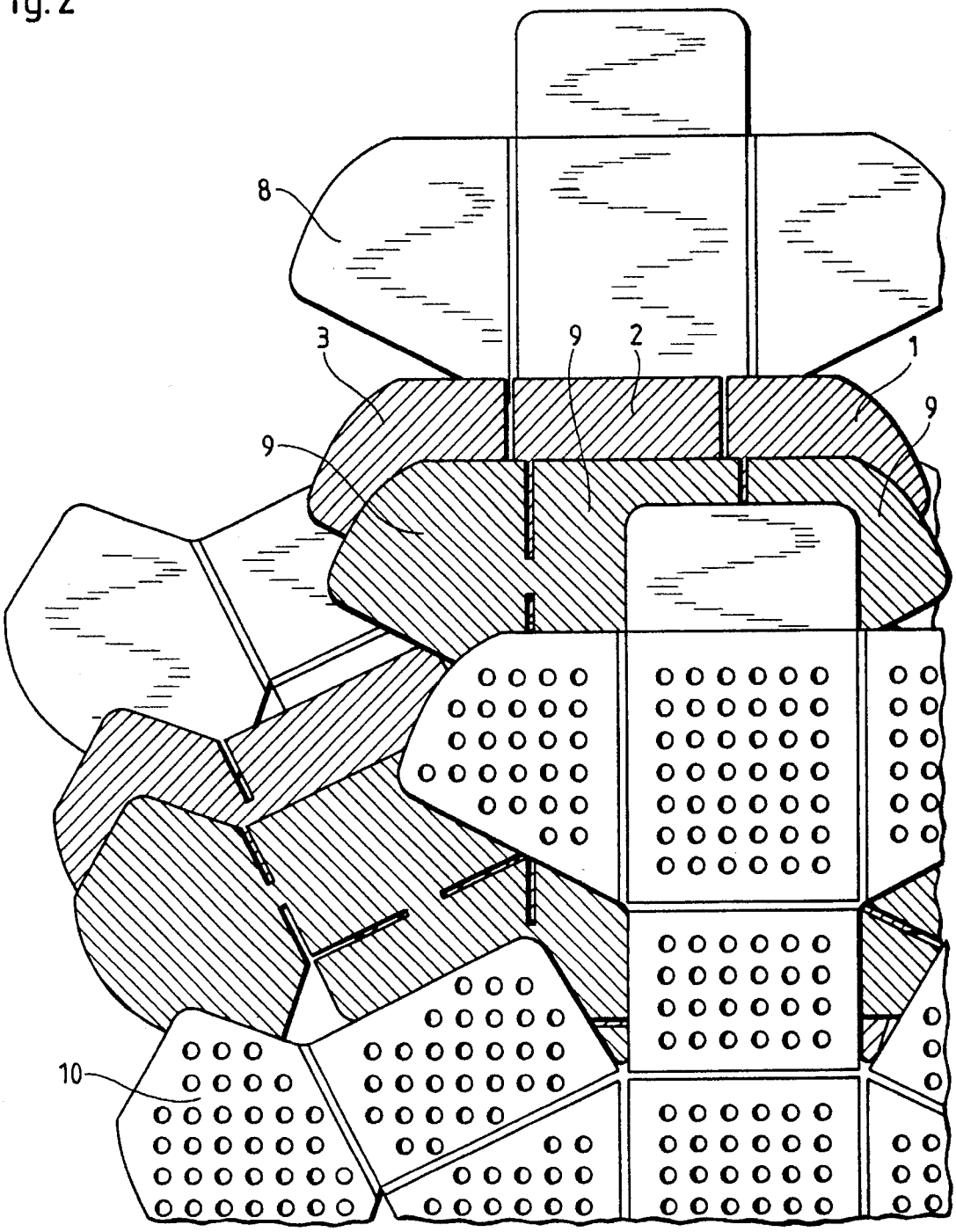
FIG. 2 is an exploded view of part of the protector of FIG. 1.
Figure 3:
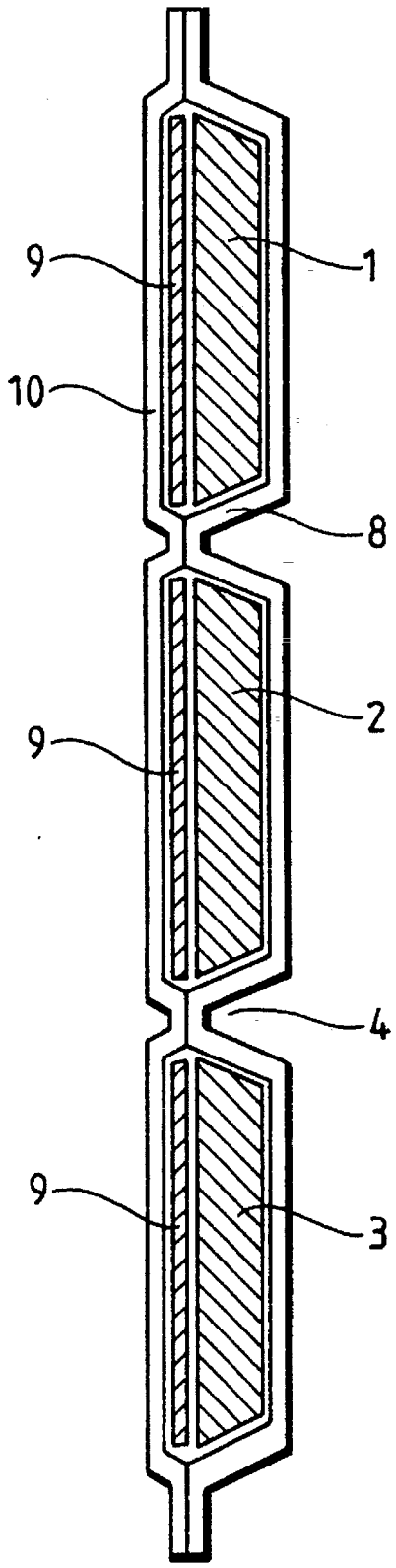
FIG. 3 is a section on the line A–B in FIG. 1.
Figure 4:
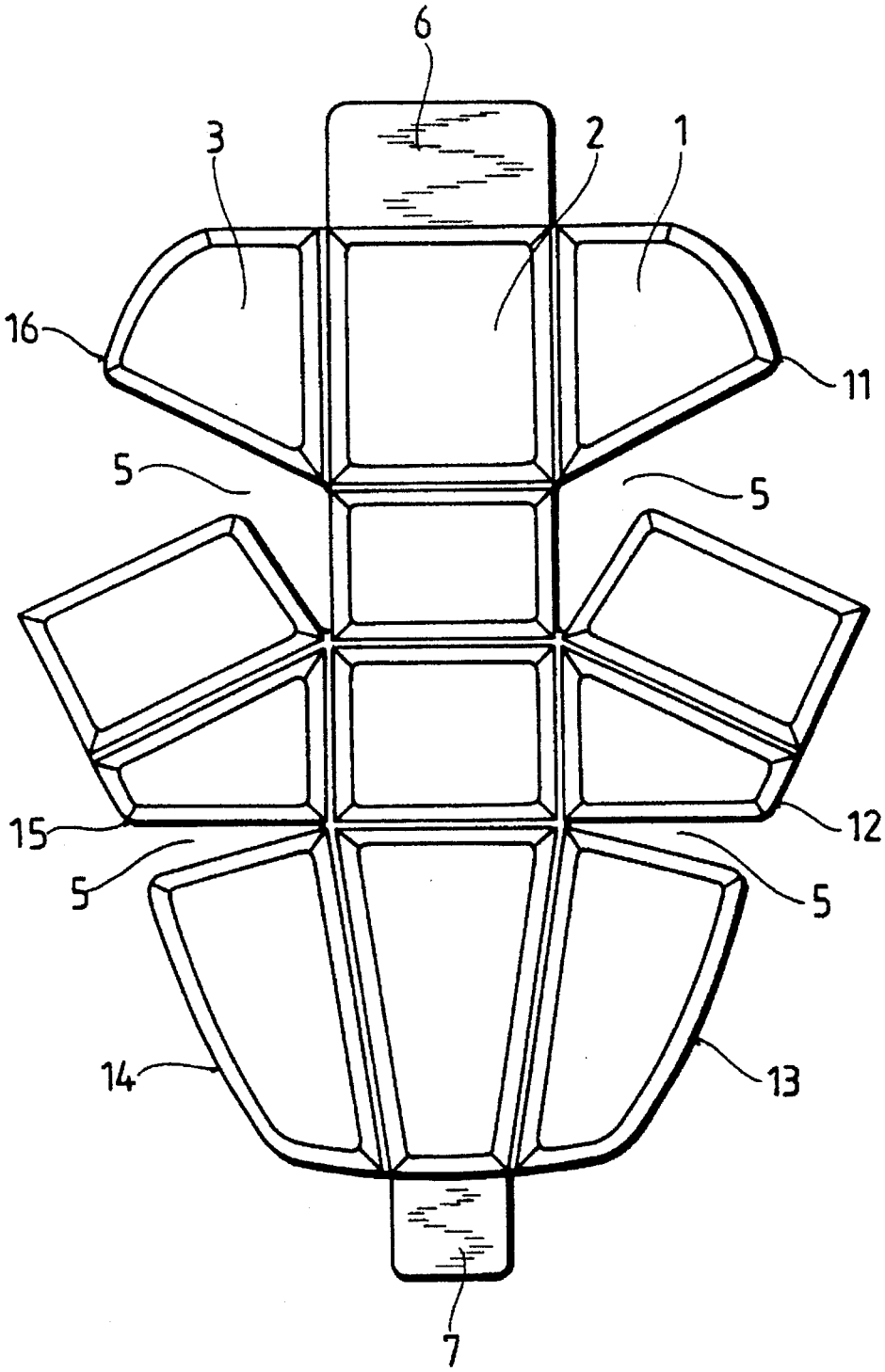
FIG. 4 is a plan view from above of an elbow protector.

The protector consists, as can be seen from FIGS. 1, 2 and 3, of an underlay 8 with pressure distributors 9 corresponding to the number of the segments and truncated pyramidal segments 1, 2, 3 of a hard, tough foamed plastic and a polyethylene covering layer 10.

After manufacture the protector is a flat structure from which a spheroidal body can be made by moving the panels 11, 12, 13, 14, 15, 16, each consisting of several segments such as 1, 2, 3, together so that the complementary outside edges shown in bold lines in the drawings adjoin one another and form a substantially closed shell-like body that conforms to the shape of the knee. For improved ventilation the underlay 8 is provided with dome-shaped recesses 17.

Figure 5:
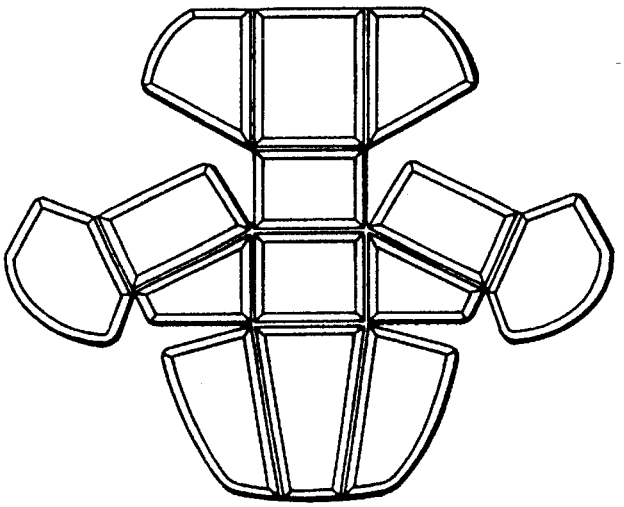
FIG. 5 shows the protector of FIG. 4, reduced in size by individual or several segments.
Figure 5:
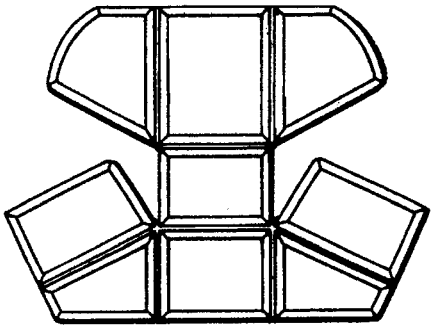
Figure 5:
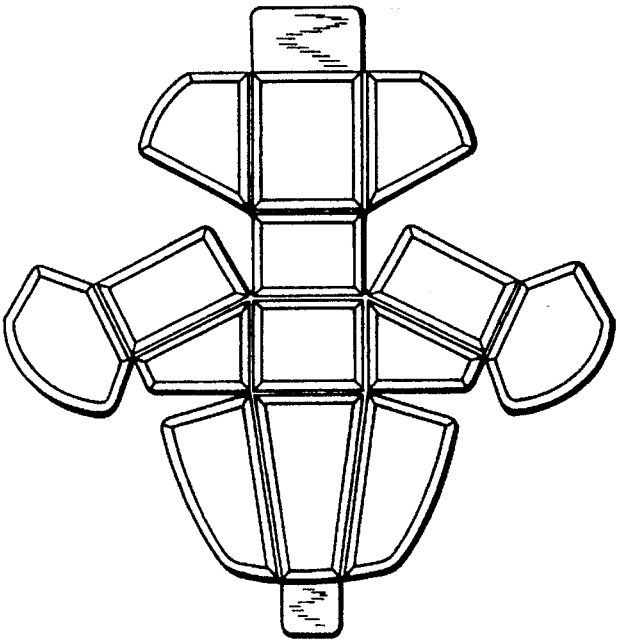
Figure 5:
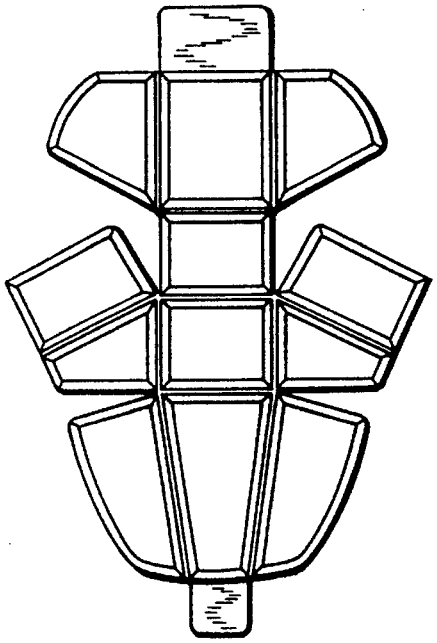

Removal of individual segments or groups of segments provides the possibility in particular cases of reducing the size of the protector and/or adapting it to particular requirements or parts of the body, as shown in FIG. 5.

What is claimed is:

1. A protector for an articulated body joint comprising:

a plurality of complementary protector elements having each:

an underlay;

a covering layer of a yieldable material; and a shock-absorbing segment arranged between the underlay and the covering layer;

grooves having a wedge-shaped cross-section and separating the protector elements form each other, the protector elements being connected with each other along bottom surfaces of the wedge-shaped grooves;

wherein some of the protector elements have complementary outer edges spaced from each other and defining empty spaces between respective protector elements, which empty spaces have a substantially triangular shape such that the empty spaces disappear on bending the protector and permit the protector to adopt a spheroidal shape corresponding to the protectable articulated body joint.

2. A protector according to claim 1, wherein the segment consists of a hard, tough open-cell foamed plastic.

3. A protector according to claim 1 in which the underlay and the covering layer consist of polyethylene foam.

4. A protector according to claim 1 in which a pressure distributor layer is located between the segment and at least one of the underlay and the covering layer.

5. A protector according to claim 1, in which the segment is welded between the underlay and the covering layer.

6. A protector according to claim 1, in which the segment is in a form of a truncated pyramid.

7. A protector according to claim 1 in which the underlay is provided with recesses.

* * * * *